United States Patent [19]

Berthet

[11] Patent Number: 4,690,281

[45] Date of Patent: Sep. 1, 1987

[54] ASSEMBLY FOR STORING, TRANSPORTING AND DISTRIBUTING OBJECTS OF THE BOTTLE, FLASK OR SIMILAR TYPES AND PROCESS FOR MANUFACTURING SAME

[75] Inventor: Maurice Berthet, Coudoux, France

[73] Assignee: Compagnie Gervais Danone, Levallois-Perret, France

[21] Appl. No.: 6,301

[22] Filed: Jan. 15, 1987

Related U.S. Application Data

[63] Continuation of Ser. No. 799,386, Nov. 18, 1985, abandoned.

[30] Foreign Application Priority Data

Nov. 16, 1984 [FR] France ..... 84 17503

[51] Int. Cl.[4] ..... B65D 19/00

[52] U.S. Cl. ..... 206/597; 206/497; 206/386

[58] Field of Search ..... 206/197, 321, 322, 386, 206/497, 597, 599; 108/56.1, 56.3

[56] References Cited

U.S. PATENT DOCUMENTS

| | | | |
|---|---|---|---|
| 2,896,207 | 7/1959 | Wilson | 206/597 |
| 2,914,282 | 11/1959 | Budd | 206/599 |
| 3,052,397 | 9/1962 | Budd | 206/599 |
| 3,202,274 | 8/1965 | Klusmire | 206/497 |
| 3,260,358 | 7/1966 | Gottily et al. | 206/497 |
| 3,338,404 | 8/1967 | Becker et al. | 206/497 |
| 3,490,582 | 1/1970 | Farquhar | 206/497 |
| 3,493,106 | 2/1970 | Galli | 206/497 |
| 3,667,598 | 6/1972 | Zelnick | 206/497 |
| 3,986,611 | 10/1976 | Dreher | 206/497 |
| 4,036,362 | 7/1977 | Ullman | 206/497 |
| 4,036,364 | 7/1977 | Ambrose | 206/526 |
| 4,050,577 | 9/1977 | Boren | 206/322 |
| 4,061,090 | 12/1977 | Callon | 108/51.1 |
| 4,077,516 | 3/1978 | Duerr | 206/602 |
| 4,254,867 | 3/1981 | Capozziello et al. | 206/322 |

FOREIGN PATENT DOCUMENTS

| | | |
|---|---|---|
| 0050078 | 4/1982 | European Pat. Off. . |
| 2121274 | 7/1974 | France . |

*Primary Examiner*—Stephen Marcus
*Assistant Examiner*—David T. Fidei
*Attorney, Agent, or Firm*—Browdy and Neimark

[57] ABSTRACT

A new assembly is provided for storing, transporting and distributing objects, comprising an ordinary standard transport pallet called main pallet, at least two secondary storage and handling pallets, each of said secondary pallets being provided with at least one row of feet or supports set back with respect to the edge of the pallet and a single cover made from a hot shrink plastic material, the upper surface of said cover comprising recessed and holding zones placed at the level of the separation of the load above the secondary pallets.

6 Claims, 6 Drawing Figures

ASSEMBLY FOR STORING, TRANSPORTING AND DISTRIBUTING OBJECTS OF THE BOTTLE, FLASK OR SIMILAR TYPES AND PROCESS FOR MANUFACTURING SAME

This is a continuation of application Ser. No. 799,386, filed Nov. 18, 1985, now abandoned.

BACKGROUND OF THE INVENTION

1. Field of the Invention

The present invention relates to a novel assembly for storing, transporting and distributing objects of the bottle, flask and similar types and a process for manufacturing same.

2. Description of the Prior Art

Pallets, whether they are of the single face kind or are provided with removable covers such as they are designed at present (80 cm×120 cm, standardized dimension) are perfectly suitable for transporting and handling, more especially by means of fork-lift trucks.

Very often, and more especially in the case of transporting and storing goods in the form of bottles, (wines, beers, etc . . . ) the pallet and its load are enveloped in a hot shrink plastic cover. This packing allows not only fragile materials to be transported in all safety, but it also ensures that the goods are held safely in position during distribution and storage in shops (large stores or supermarkets more especially). This system (standard pallet, containers for the bottles, retractable plastic material cover) has already been in operation for several years and gives every satisfaction, more especially in the case of goods with rapid turn over.

It is not at all the same for goods with a slower turn over (vinegar, for example). Not only is the pallet immobilized for a long time, but in addition, since it is of standard dimensions it occupies too large an area, which fact is an inconvenience for a large number of shops.

A first attempt to overcome this ticklish problem consisted in using two half pallets placed on the standard pallet (obligatory for the transport), each of these half pallets with its containers containing the bottles becoming independent during storage and during distribution in the large store. Although the problem of area was perfectly solved, the same cannot be said in so far as the safety of the goods is concerned. In fact, once the plastic material protective cover was removed, the two half pallets were no longer securely held during handling at the selling points and considerable damage resulted therefrom. Of course, the problem could be solved by providing three cover protections: a cover for each half pallet and a cover for the whole (pallet plus the two half pallets), during transport, but this solution could not be adopted for it was much too expensive.

The aim of the present invention is therefore to provide a new assembly for transporting, storing and distributing objects such as bottles, flasks, jars or similar which complies better with the requirements of practice than the previously known system and more especially for goods with slow turn over, more particularly in that it allows reduced occupation of the ground and perfect security not only during the transport but also during handling and distribution of the goods.

SUMMARY OF THE INVENTION

The present invention provides then an assembly for transporting, storing and distributing objects of the bottle, flask, jar and similar types, formed from an ordinary standard transport pallet called main pallet and at least two secondary storage and handling pallets, each of said secondary pallets being provided with at least one row of feet or supports set back with respect to the edge of the pallet and a single hot shrink plastic material cover. The upper surface of said cover comprises recessed and holding zones placed at the separation between the secondary pallets.

This device, after shrinking of the cover, allows each of the secondary pallets with their respective load stacked thereon to be held in position perfectly rigidly even after separation of the different secondary pallets at the place of distribution.

In fact, the shrunk cover holds the load at the lower part by adhering to the inner surface of the secondary pallet situated between the edge and the row of set back feet and it holds the loads at the upper part because of the recessed zone placed precisely at the level of separation between said secondary pallets.

In an advantageous embodiment of the present invention, the set back row of feet (or supports) of the secondary pallet are at a distance of about 2 to 15 cm from the edge of said pallet.

In another advantageous embodiment of the present invention, the recessed and holding zone extends over the whole length of the secondary pallet without solution of continuity all along the separation between the two consecutive secondary pallets.

In another embodiment of the invention, the recessed and holding zone is formed of a plurality of separate zones all situated at the level of the separation between the two secondary pallets.

In yet another advantageous embodiment of the present invention, the cover is fixed by stapling, bonding or similar to the secondary pallet at the position close to the junction between said secondary pallets.

The present invention also provides a process for manufacturing the assembly in accordance with the invention, in which process the secondary pallets are disposed on the main standard pallet so that the row of feet (or supports) set back with respect to the edge of the pallet is situated also close to the edge of the main pallet, the containers or similar containing the products to be distributed are stacked on the secondary pallets, the whole of the secondary pallets with their loads are enveloped in a single hot shrink plastic material cover, the edges of the cover are placed under the secondary pallets on the surface defined by the edge and the row of set back feet (or supports), the recessed and holding zones are formed by applying one—or a plurality—of forces on the upper flat surface of the cover at the precise positions of separation between the secondary pallets during heating (in the packing machine or oven) for shrinking the cover.

These recessed and holding zones thus formed remain folded even after the plastic material forming the cover has been cut so as to separate the secondary pallets and their load for transporting them to the selling and distribution points.

Apart from the foregoing arrangements, the invention further comprises other arrangements which will be clear from the following description.

The invention provides more particularly a device and an assembly for transporting, storing, handling and distributing objects such as bottles, flasks jars and similar, in accordance with the preceding arrangements, as well as the means adapted for manufacturing and using same, as well as the installations in which said system and process are included.

BRIEF DESCRIPTION OF THE DRAWINGS

The invention will be better understood from the complement of description which follows with reference to the accompanying drawings in which.

It should of course be understood that the drawings and the corresponding descriptive parts are given solely by way of illustration of the invention of which they form in no wise a limitation.

DESCRIPTION OF THE PREFERRED EMBODIMENTS

Figure 1:
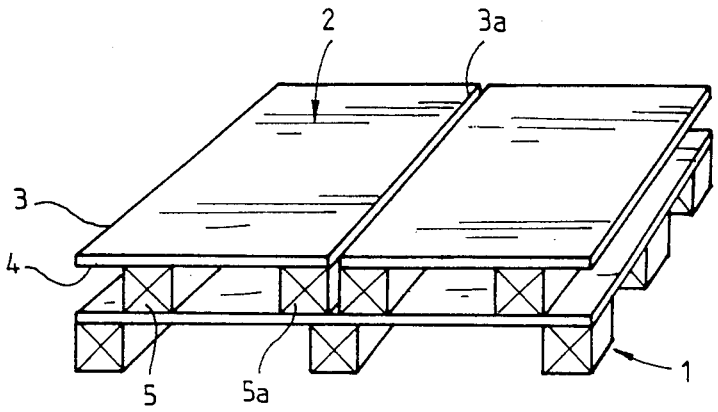
FIG. 1 shows in section two secondary pallets placed on a main standard pallet.
Figure 2:
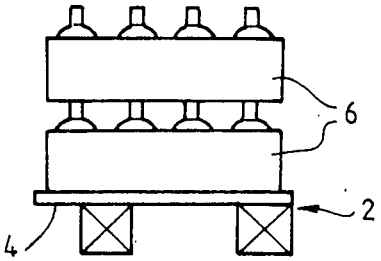
FIG. 2 shows a secondary pallet and its load.
Figure 3:
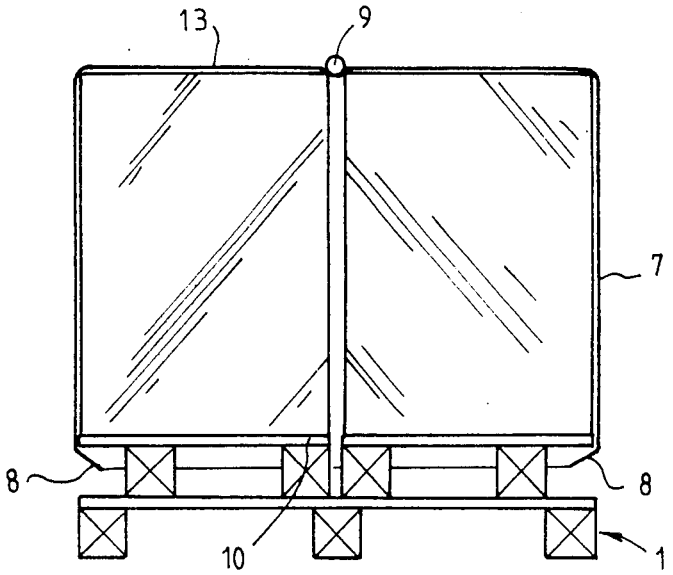
FIG. 3 shows as assembly before shrinking of the plastic material cover.

Each secondary pallet 2 in accordance with the present invention, shown by way of non limitative example in the drawings, comprises a row of feet 5 set back with respect to the edge 3. Thus a surface 4 is formed against which the plastic material cover will adhere. FIG. 1 shows two secondary pallets 2 placed on the main standard pallet 1. The two secondary pallets are joined at 3*a*, the row of feet 5*a* being fixed to the very edge of the secondary pallet. The containers 6 containing for example bottles are loaded on each of the secondary pallets 2 (cf. FIG. 2) then the two secondary pallets are placed so that the two outwardly turned rows of feet 5 are covered by the shrinkable plastic material cover 7. The edges 8 of the cover are placed so as to cover the surface 4 defined by the edges 3 and the row of feet 5. On the upper surface 13 of the cover 7 (cf. FIG. 3), the future recessed and holding zone is formed by placing for example a steel bar 9 at the precise position corresponding to the separation between the two secondary pallets 2. If desired the cover may be fixed for example by a staple on the edge of the secondary pallet.

Figure 5:
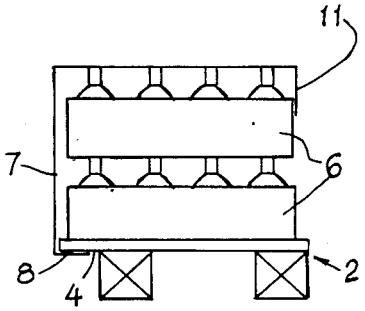
FIG. 5 shows the assembly of FIG. 4, taken in cross-section along line 5—5, after secondary pallets 2 have been separated by tearing of the shrink wrap along line 12.
Figure 4:
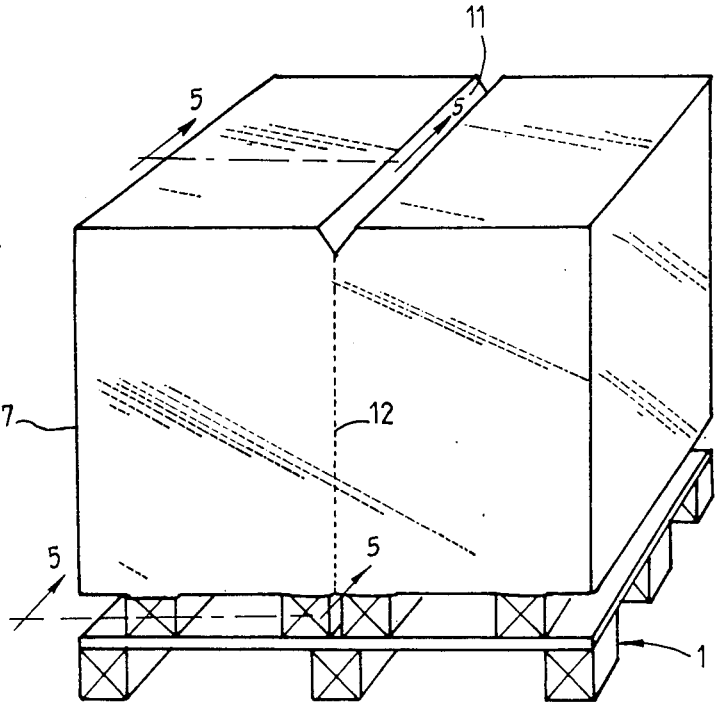
FIG. 4 shows the same assembly after shrinkage of the cover.

FIG. 4 shows the assembly of the invention after shrinkage of the cover 7. At the position where part 7 was placed the recessed zone 11 has been formed. This holding zone 11 is folded and as shown in FIG. 5, forms a tongue which holds in position the load of each of the pallets 2 after separation of the different secondary pallets 2 obtained by cutting the covers 7 along line 12 which separates the secondary pallets 2 from each other with their load of containers 6.

As is clear from the foregoing, the invention is in no wise limited to those of its embodiments and modes of application which have just been described more explicitly; it embraces, on the contrary, all variants thereof which may occur to a technician skilled in the matter, without departing from the scope or spirit of the present invention.

What is claimed is:

1. A packing and transport device for bottles, flasks, and jars as articles to be held thereon, comprising a first primary transport pallet with primary platform and two rows of primary support feet, at least two secondary pallets, said secondary pallets being placed side-by-side to define a junction interface between said articles on each said secondary pallet, each said secondary pallet comprising a secondary platform for receiving said articles, and each pallet having first and second rows of secondary support feet resting on the primary platform, said first row of secondary support feet being placed under the secondary platform and spaced inwardly from a first edge of said secondary platform opposite said junction interface to define along said first edge a free edge zone on said secondary platform, and a heat shrinkable material film cover enveloping the whole of said articles for holding said articles in position on the secondary pallets, said cover being fixed to said secondary pallets on the free edge zones of their respective secondary platforms, said heat shrinkable film further comprising, for holding said articles in position on each of said secondary pallets, individual folded holding zones disposed substantially along the function interface which, when said cover is slit along the length of said junction interface and said secondary pallets separated, form tongues which hold said articles on each said respective secondary pallet.

2. The device as claimed in claim 1, wherein the zones for holding said articles carried by each of said secondary pallets extend continuously over the top of the cover along a line extending substantially in the plane of the interface and substantially over the whole length of the top of the cover measured parallel to said plane.

3. The device as claimed in claim 1, wherein the holding zones are spaced along a line extending on the top of the cover, substantially in the plane of the interface of the articles carried by said secondary pallets, substantially over the whole length of the top of the cover measured parallel to said plane.

4. The device as claimed in claim 1, wherein the heat shrinkable material film cover is also fixed to at least one of the secondary pallets on an edge of the platform of said secondary pallet, by stapling or bonding, said fixing taking place on said secondary pallet near said interface.

5. The device as claimed in claim 1, wherein the second row of secondary support feet is disposed substantially along a second edge of said secondary pallet opposite to said first edge and the distance from said first edge to said first row of each of said secondary pallets is about 2 to 15 cm.

6. The device of claim 1, wherein said folded holding zones are formed by the application of force to the top of said cover specifically along a portion a top surface of said film cover corresponding to said interface while heat shrinking said film cover.

* * * * *